US012240583B2

(12) United States Patent
Venables et al.

(10) Patent No.: US 12,240,583 B2
(45) Date of Patent: Mar. 4, 2025

(54) MARINE VESSEL BRAKE ASSIST AND STABILIZATION SYSTEM

(71) Applicant: Naiad Maritime Group, Inc., Shelton, CT (US)

(72) Inventors: John D. Venables, Monroe, CT (US); Christopher M. Pappas, Saint Leonard, MD (US)

(73) Assignee: Maiad Maritime Group, Inc., Shelton, CT (US)

( * ) Notice: Subject to any disclaimer, the term of this patent is extended or adjusted under 35 U.S.C. 154(b) by 652 days.

(21) Appl. No.: 17/513,654

(22) Filed: Oct. 28, 2021

(65) Prior Publication Data

US 2022/0126972 A1 Apr. 28, 2022

Related U.S. Application Data

(60) Provisional application No. 63/106,621, filed on Oct. 28, 2020.

(51) Int. Cl.

| | |
|---|---|
| ***B63H 25/44*** | (2006.01) |
| ***B63B 39/06*** | (2006.01) |
| ***B63B 79/10*** | (2020.01) |

(52) U.S. Cl.

CPC ..... *B63H 25/44* (2013.01); *B63B 39/06* (2013.01); *B63B 79/10* (2020.01)

(58) Field of Classification Search

CPC .... B63H 25/382; B63H 25/383; B63H 25/44; B63H 25/48; B63H 25/50; B63H 21/21; B63B 39/06; B63B 39/061; B63B 39/062; B63B 2039/065; B63B 2039/066; B63B 2039/067; B63B 2039/068; B63B 79/10

See application file for complete search history.

(56) References Cited

U.S. PATENT DOCUMENTS 6,691,634 B2 * 2/2004 Fritchle ..... B63H 25/44 114/145 R
6,827,031 B2 * 12/2004 Aoyama ..... B63H 25/44 114/284

(Continued)

FOREIGN PATENT DOCUMENTS

CN 107140171 A * 9/2017
GB 1337505 A * 11/1973

(Continued)

OTHER PUBLICATIONS

International Search Report and Written Opinion for Application No. PCT/ US2021/057105.

*Primary Examiner* — Ajay Vasudeva

(74) *Attorney, Agent, or Firm* — Farber LLC; Jonathan A. Winter

(57) ABSTRACT

A vessel braking control system for a marine vessel that utilizes one or more of the vessel's features and effectors to increase the drag on the vessel both through increased drag on the features and effectors themselves and by creating a downward force on the vessel as a whole, increasing the wetted hull area and increasing hull drag thereby; the control system operates to place the features and effectors in a braking state through rotation relative to the vessel's direction of travel and relative to the water's surface, and may automatically return the features and effectors to their normal operating state upon the vessel's reaching a detected, predetermined speed.

19 Claims, 8 Drawing Sheets

(56) References Cited

U.S. PATENT DOCUMENTS

| | | | | |
|---|---|---|---|---|
| 11,915,595 | B2 * | 2/2024 | Tomita | G08G 3/02 |
| 2012/0021660 | A1 | 1/2012 | St-Pierre et al. | |
| 2018/0237113 | A1 | 8/2018 | Venables et al. | |
| 2019/0361457 | A1 | 11/2019 | Johnson et al. | |

FOREIGN PATENT DOCUMENTS

| | | | | |
|---|---|---|---|---|
| JP | 02227390 | A | * | 9/1990 |
| JP | 5213729 | B2 | * | 6/2013 |

* cited by examiner

Fig. 5A
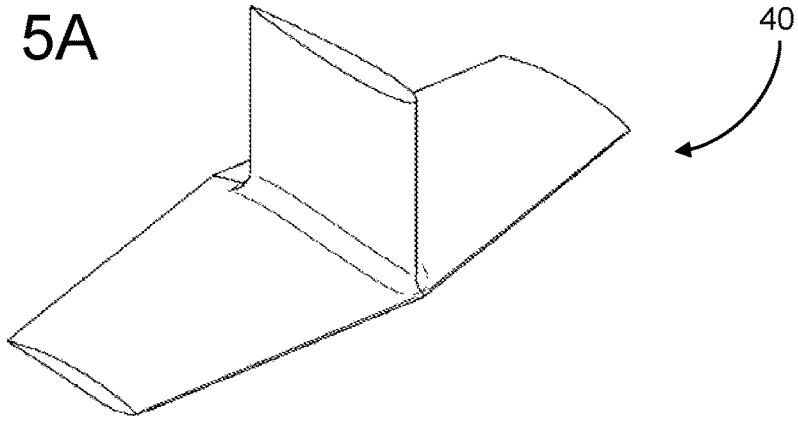
Fig. 5B
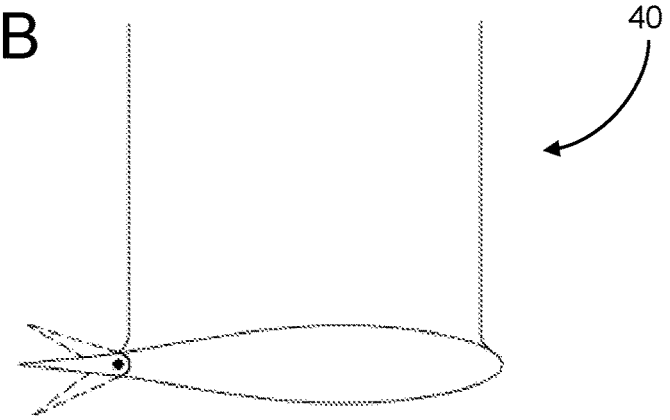
Fig. 5C
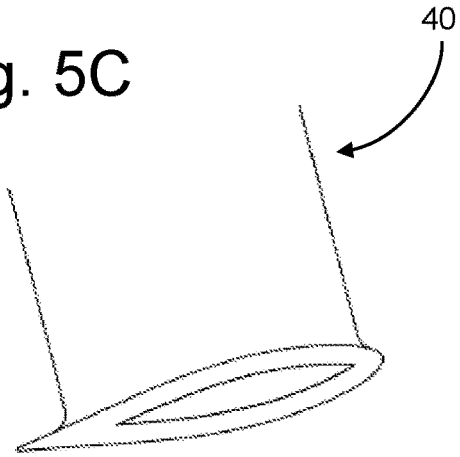
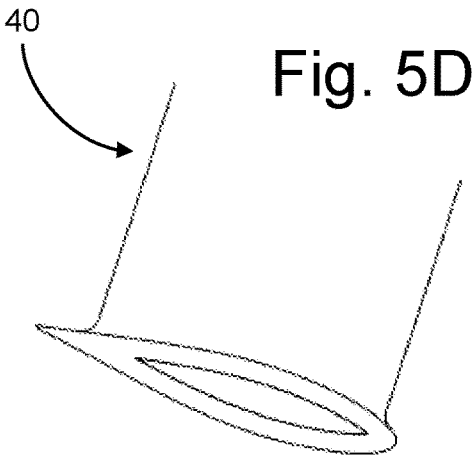
Fig. 5D

MARINE VESSEL BRAKE ASSIST AND STABILIZATION SYSTEM

FIELD OF THE INVENTION

The invention relates to a brake assist control and stabilization system for marine vessels in motion.

BACKGROUND OF THE INVENTION

Many features and techniques exist for affecting a marine vessel's performance in the water. Features such as stabilizer fins are employed on many vessels to reduce undesirable motions and provide a smoother traveling experience. Features such as interceptors, trim tabs, and foils are commonly used to elevate a vessel, or a portion thereof, to counteract undesirable motions, reduce drag and improve fuel efficiency and performance, or to otherwise improve the occupants' experience. These features are generally controlled by means of a control system and employ hydraulic or electrical activation means. They are often employed to improve the performance of a marine vessel in motion or at rest but are not typically considered for use as a part of a braking or slowing system for a vessel.

Instead, marine vessels utilize the drag created by water on the vessel's hull to slowly come to a stop. In instances when more rapid stopping is necessary, marine vessels typically drop anchor and/or employ astern propulsion using the vessel's propulsion system, if available. However, there remains a need for a more effective system for slowing and stopping the forward motion of marine vessels in situations that include, but are not limited to, emergency stop situations.

SUMMARY OF THE INVENTION

It is accordingly an object of the present invention to provide a system that utilizes one or more of the features of a marine vessel to improve stopping time and distance. It is a further object of the present invention to provide features and a control system to implement the transition to a marine vessel braking protocol when the control system is activated by the operator of a marine vessel.

To accomplish these objectives the present invention employs a control system connected to an activation switch accessible by the operator of the vessel. The activation switch may employ any one of a number of known activation methods, such as buttons, levers, etc., but is preferably clearly labeled to notify the operator of the switch's function. Upon activation of the control switch, the control system enacts a vessel braking protocol throughout one or more of the features of the vessel.

For example, preferable embodiments of the control system electronically communicate with the vessel's one or more stabilizer fins, whether retractable or non-retractable, and rotate said stabilizer fins in a clockwise or counterclockwise direction relative to the vessel's hull while they are submerged. In preferable embodiments, the control system instructs one or more stabilizer fins on the port side of the vessel's hull to rotate in a clockwise direction while it instructs one or more stabilizer fins on the starboard side of the vessel's hull to rotate in a counterclockwise direction, thereby creating a "snow plow" effect that increases the force of the water in an astern direction. The degree of rotation may be anywhere up to 90 degrees from neutral but is preferably in the 0-60 degree range.

In addition to the rotation perpendicular to the vessel's hull, the control system may also or alternatively instruct the fins to rotate relative to a vertical axis. For example, once the control system instructs a stabilizer fin to rotate clockwise or counterclockwise relative to the vessel's hull, it may further instruct said stabilizer fin to rotate such that the lower edge (outermost edge relative to the hull) is displaced relative to the upper edge (innermost edge relative to the hull) toward the vessel's bow. In such embodiments, additional astern forces would act on the stabilizer fin(s), and the positioning of the stabilizer fin(s) creates downward force on the vessel's hull, increasing the wetted surface area of the vessel and the viscous drag of the water on the vessel's hull. Such displacement/rotation is again preferably available anywhere up to 90 degrees, with a preferable angle between 0-30 degrees relative to the lower surface plane of the vessel's hull.

The present invention is not, however, limited to the exclusive use of stabilizer fins to implement the vessel braking protocol. Indeed, the control system is preferably in electronic communication with other features of the vessel as well, such as the vessel's interceptors, trim tabs, foils, etc., if available. The control system may employ any number of such features, alternatively or in addition to the stabilizer fins, to improve the effectiveness of the vessel braking protocol. For example, the control system may instruct complete deployment of interceptors and/or trim tabs, creating a downward force on the bow and increasing the wetted surface area of the hull and the resulting hull drag. Side mounted foils, T-foils, spanning/lifting foils, and other types of effectors can likewise be used in this capacity to create additional drag and downward forces increasing hull drag. Preferably, the control system is connected to each of such features and implements the vessel braking protocol in each feature simultaneously to provide the most effective slowing/stopping of the vessel possible.

Preferable embodiments of the control system may also analyze the vessel's mass, size, speed, pitch, direction of travel, and position of effectors and features relative to the vessel's center of buoyancy to control rotation angles and optimize the effectiveness of the vessel braking protocol, and are preferably capable of doing so in real time as the vessel slows, etc. For example, for stabilizer fins located near the vessel's bow especially, displacing the lower edge toward the bow of the vessel creates significant downward force on the bow portion of the vessel's hull, thereby increasing wetted hull area and drag in the bow area while the vessel is making headway. At high speeds, however, a significant displacement angle could cause a vessel's bow to submarine if the vessel's pitch angle becomes too steep. Preferable embodiments of the control system can detect such unsafe and/or ineffective states using sensors, GPS data, etc. and can correct them in real-time. At the same time, some submersion of or lowering of the bow may be desirable in that more drag would be created to assist the vessel braking protocol.

In some preferable embodiments, after the activation control switch has been activated and the control system has implemented the vessel braking protocol in the vessel's various effectors and features, the control system may also automatically return those effectors features to a normal operating state once the vessel has reached a predetermined termination speed. Such termination speed could be set to a complete stop, 5 knots, or to any other reasonable speed, which speed may be detected by a GPS system, one or more sensors, or other known methods of detecting a marine vessel's speed. Upon the control system's detection of reaching the termination speed, the control system would then instruct each of the vessel's effectors and features that were involved in the braking operation to return to a normal operating state. The vessel's operator could also, in some embodiments, terminate the vessel braking protocol using the activation switch before the vessel has reached the termination speed. Or the control system could remain in the vessel braking protocol indefinitely until the vessel's operator deactivates the activation switch.

Emergency stop operation is intended for use in conjunction with current emergency stop procedures, such as reversing propulsion. Detailed analysis or simulation of the vessel parameters and the fitted features and effectors should preferably be performed to ensure the subject vessel can withstand the forces created from the use of the present invention's control system. Indeed, some of the vessel's features, when in the vessel braking/emergency stop state, operate atypically and in a manner generally advised against. For example, in preferable embodiments of the control system that utilize a vessel's foil(s) to assist in the vessel braking protocol, the control system may well rotate the foil(s) beyond the stall angle or critical angle while making headway, potentially creating cavitation of water flow and/or other circumstances that in normal situations would be problematic to a vessel underway/making headway. Specifically, traditional control systems seek to stabilize a vessel without creating excess drag when underway, but rotating foils beyond their stall angle or critical angle of attack when underway would not be advisable under normal circumstances. It is accordingly important that the vessel's effectors and features are capable of sustaining such operation states when and if the control system is activated.

As those skilled in the art will appreciate, the present invention is not limited to the embodiments and arrangements described above. Other objects of the present invention and its particular features and advantages will become more apparent from consideration of the following drawings and detailed description of the invention.

BRIEF DESCRIPTION OF THE DRAWINGS

FIG. 5A depicts a partial perspective view of a T-foil utilized by the exemplary vessel outfitted with the vessel braking control system of FIGS. 1-4.

FIG. 5B depicts a partial orthogonal view from the side of a T-foil utilized by the exemplary vessel outfitted with the vessel braking control system of FIGS. 1-4 and 5A, the T-foil depicted in a rotationally neutral position with an active trailing flap for lift generation.

FIG. 5C depicts a partial orthogonal view from the side of a T-foil utilized by the exemplary vessel outfitted with the vessel braking control system of FIGS. 1-4 and 5A-B, the T-foil depicted in a rotated position.

FIG. 5D depicts a partial orthogonal view from the side of a T-foil utilized by the exemplary vessel outfitted with the vessel braking control system of FIGS. 1-4 and 5A-C, the T-foil depicted in a rotated position.

DETAILED DESCRIPTION OF THE INVENTION

The following detailed description illustrates the technology by way of example, not by way of limitation of the principles of the invention. This description will enable one skilled in the art to make and use the invention, and describes several embodiments, adaptations, variations, alternatives and uses, including what is presently believed to be the best mode of carrying out the invention. One skilled in the art will recognize alternative variations and arrangements, and the present invention is not limited to those embodiments described hereafter.

Figure 1:
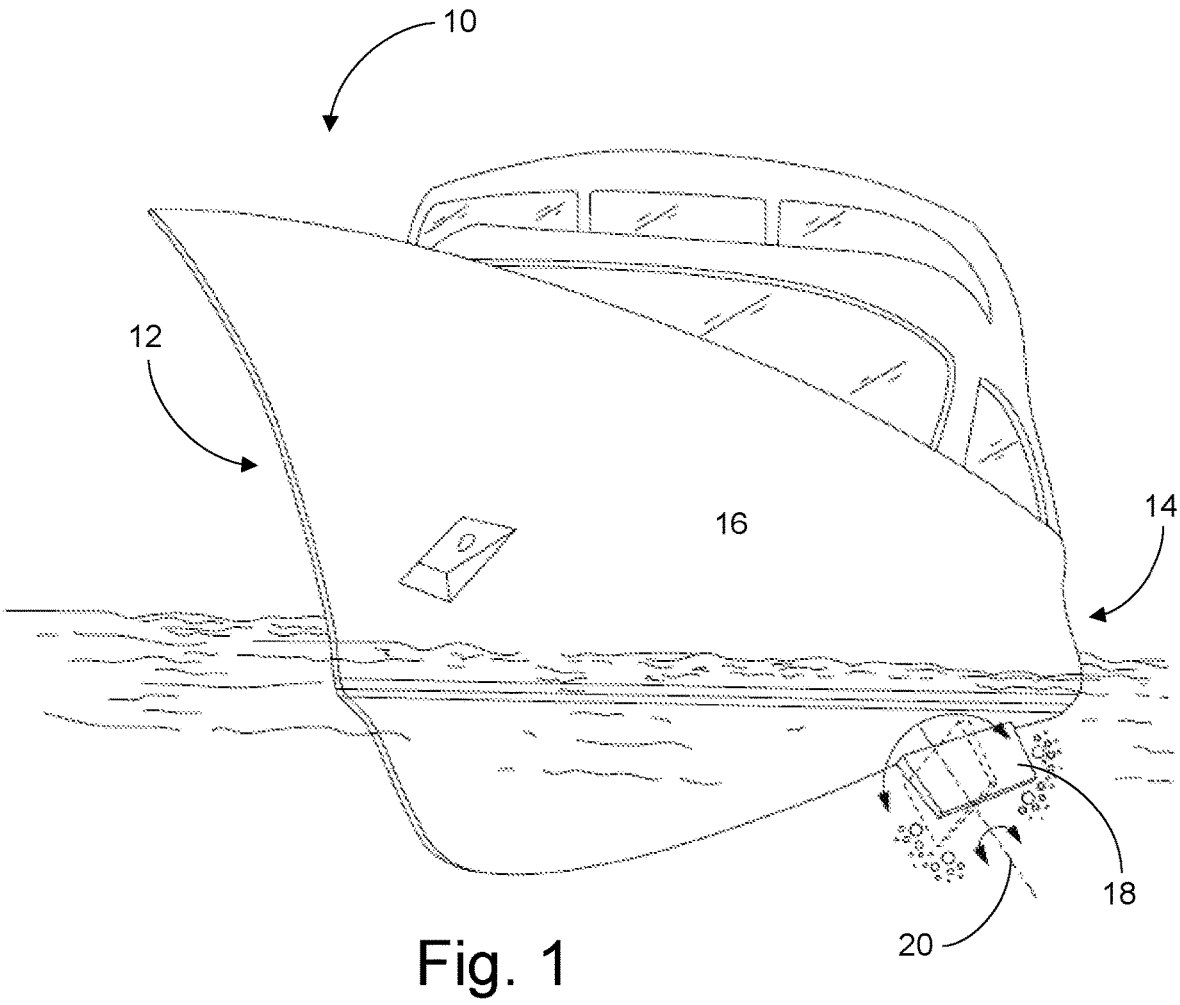
FIG. 1 depicts a perspective view from the port side of the bow of an exemplary vessel outfitted with the vessel braking control system of the present invention.

Referring to FIG. 1, the vessel 10 illustrated has stabilizer fins 18 located on the starboard (not visible) and port (depicted) sides of the vessel's hull 16 near amidships. Upon activation of the emergency stop switch 72, the control system 70 places the stabilizer fins 18 in the emergency stop state by rotating each to create a "snow plow" effect, increasing the water's drag on the vessel's hull 16 and slowing the vessel's movement. The rotation angle is preferably between 0 and 60 degrees, or more preferably between 15 and 40 degrees, but may go as high as 90 degrees and may be dependent on the vessel's mass, size, speed, pitch, direction of travel, the position of the stabilizer fins relative to the vessel's center of buoyancy, etc. The fins 18 on either side of the hull 16, which would typically rotate in the same direction when stabilizing the vessel 10 by counteracting roll, instead rotate in opposite directions when used by the braking control system 70 to help slow the speed of the vessel 10. To state it another way, the trailing edge of each fin 18 preferably rotates outboard and/or upward when engaged by the control system 70 for braking. So the starboard-side stabilization fin 18 would preferably rotate counter-clockwise while the port-side stabilization fin 18 would preferably rotate clockwise, although the opposite arrangement may also be employed, with the starboard-side stabilization fin 18 rotating clockwise and the port-side stabilization fin 18 rotating counter-clockwise.

In preferable embodiments, the stabilizer fins 18 may also rotate relative to the bottom of the vessel's hull 16 such that the fins' 18 lower edges are displaced relative to their upper portions toward the vessel's bow 12. In such embodiments, additional downward force is applied to the hull 16, forcing the vessel 10 lower in the water and increasing the wetted hull area and the drag on the hull 16. Some preferable embodiments further utilize the control system 70 to avoid problematic outcomes, such as submarining, by employing sensors 74 to accumulate data on the vessel's 10 status and avoid excess pitch, etc. The preferable displacement angle is between 0 and 30 degrees, or more preferably between 5 and 25 degrees, but may go as high as 90 degrees and may be dependent on the vessel's mass, size, speed, pitch, direction of travel, the position of the stabilizer fins 18 relative to the vessel's center of buoyancy, etc. Some preferable embodiments of the control system 70 will also avoid overloading the effectors by attenuating their deployment based on vessel speed via sensors 74. As the vessel speed slows, the effector deployment can be automatically increased until the desired speed is attained.

Once the vessel 10 has slowed to a predetermined speed, some preferable embodiments of the control system 70 automatically return the stabilizer fins 18 to their normal operating position. In other embodiments, the system 70 will remain in the vessel braking/emergency stop state until the vessel's operator de-activates the activation switch 72. The speed at which the control system 70 automatically deactivates the vessel braking protocol may be preset or may be set by the operator of the vessel 10, either at the time the activation switch 72 is activated or before. Those of ordinary skill in the art will recognize the added flexibility provided through the various options for activation/deactivation of the vessel braking protocol.

There are a variety of other known stabilizers, which include fins/foils that can pivot/rotate or otherwise move. These include bow foils, stern foils, T foils, interceptors, trim tabs, and various other fins/foils that protrude from the vessel 10 (not depicted in FIG. 1). It is specifically contemplated that the present vessel braking protocol can be implemented for any of these foils or lift creating devices to deploy beyond typical angles to create drag and slow the boat. For example, a vessel 10 with two rudders 22 could have the rudders 22 rotated outwards or inwards at extreme angles to counteract each other in turning forces but increase drag to slow the vessel 10. Bow foils could be pitched down dramatically to slow the speed of the vessel 10 and lower the bow 12 to increase drag. Stern foils may be pitched drastically to create extra drag and to lower the bow 12 or lower the stern 14, depending on what is determined to be the most efficient and safe way to create excess drag and slow the vessel 10.

Traditionally when making headway existing foils are designed to minimize drag while operating to increase stability when needed. However, the present invention contemplates rotating such foils beyond their normal operating angles when the vessel 10 is making headway in order to increase drag and stop the vessel 10 as quickly as possible. Likewise, stabilizer fins 18 are typically used to stabilize a vessel 10 by, for example, angling the stabilizers 18 to counteract roll or optionally extending the stabilizer fin 18 on the side of the hull 16 opposite the roll direction. The present invention operates the stabilizer fins 18 in an atypical manner by rotating both sides nose down or nose up and/or extending both sides and rotating them simultaneously (e.g. one clockwise, the other counter-clockwise) to assist in enacting the vessel braking protocol.

Figure 2A:
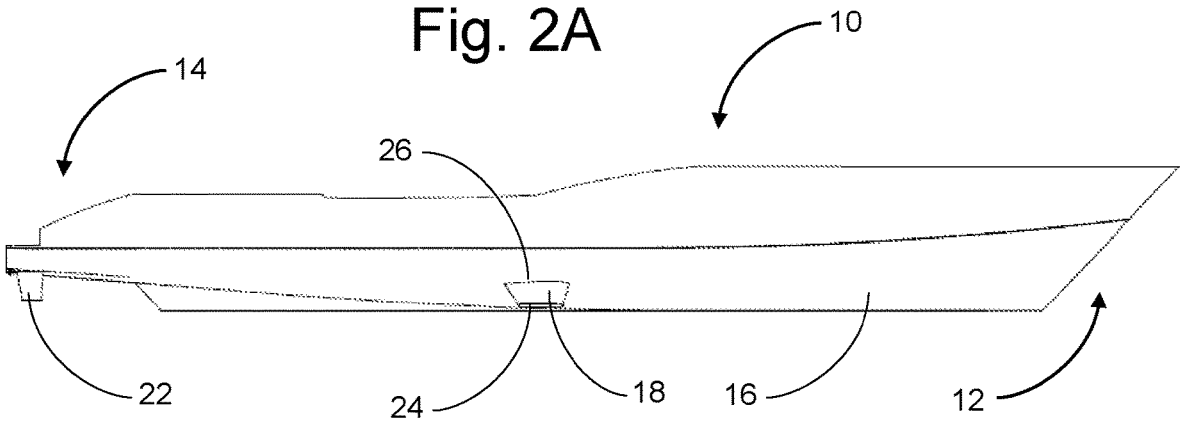
FIG. 2A depicts an orthogonal view from the starboard side of the exemplary vessel outfitted with the vessel braking control system of FIG. 1, with the depicted fin in the neutral position.
Figure 2B:
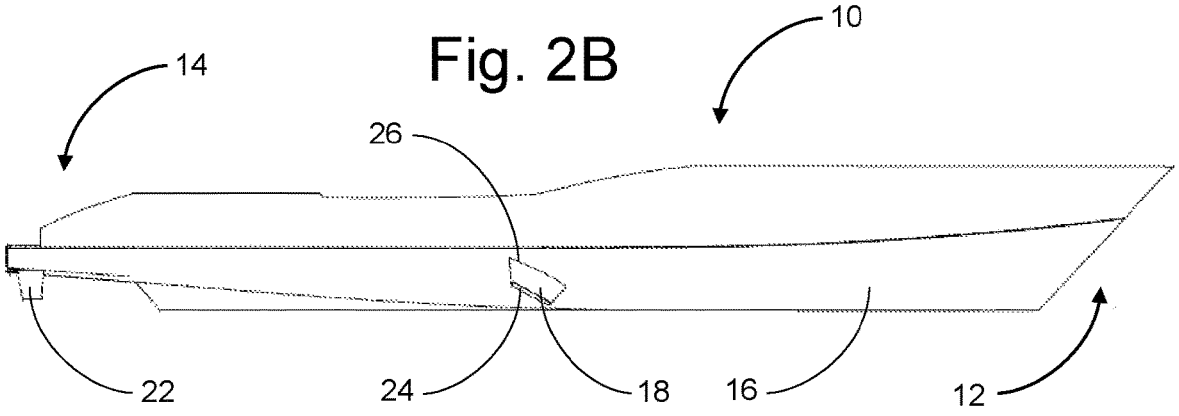
FIG. 2B depicts an orthogonal view from the starboard side of the exemplary vessel outfitted with the vessel braking control system of FIGS. 1 and 2A, with the depicted fin in a rotated position.

Referring now to FIGS. 2A and 2B, a view from the starboard side of an exemplary vessel's hull 16 employing the vessel braking control system 70 of the present invention is depicted. Preferable embodiments of the hull 16 of such exemplary vessels 10 include stabilizer fins 18 and one or more rudders 22. The rudders 22 may employ interceptors 30, T-foils 40, trim tabs 50, or other known features and stabilizers. Likewise, such interceptors 30, T-foils 40, trim tabs 50, or other known features and stabilizers may be employed elsewhere on the vessel's hull 16 and be employed by the control system 70 when the vessel 10 is placed in the braking protocol.

The vessel 10 depicted in FIG. 2A depicts the stabilizer fins 18 in the neutral position wherein they are not engaged in slowing the vessel's speed and are oriented substantially parallel to neutral angle line 20, which is preferably substantially perpendicular to the surface of the hull 16 from which the fins 18 protrude. In FIG. 2B, the vessel 10 is instead depicted with the stabilizer fins 18 in a rotated state, which occurs when the control system 70 engages the braking protocol, such that the stabilizer fins 18 increase drag from the water and assist in slowing the vessel 10. As noted, preferable embodiments of the stabilizer fins 18 rotate about neutral angle line 20 as well as creating a negative angle by displacing the fins' lower, outermost edges 24 relative to the fins' upper, innermost edges 26, causing downward pressure on the hull 16 and increasing the wetted surface area of the vessel 10 and the viscous drag of the water on the vessel's hull 16 as a result.

Figure 3A:
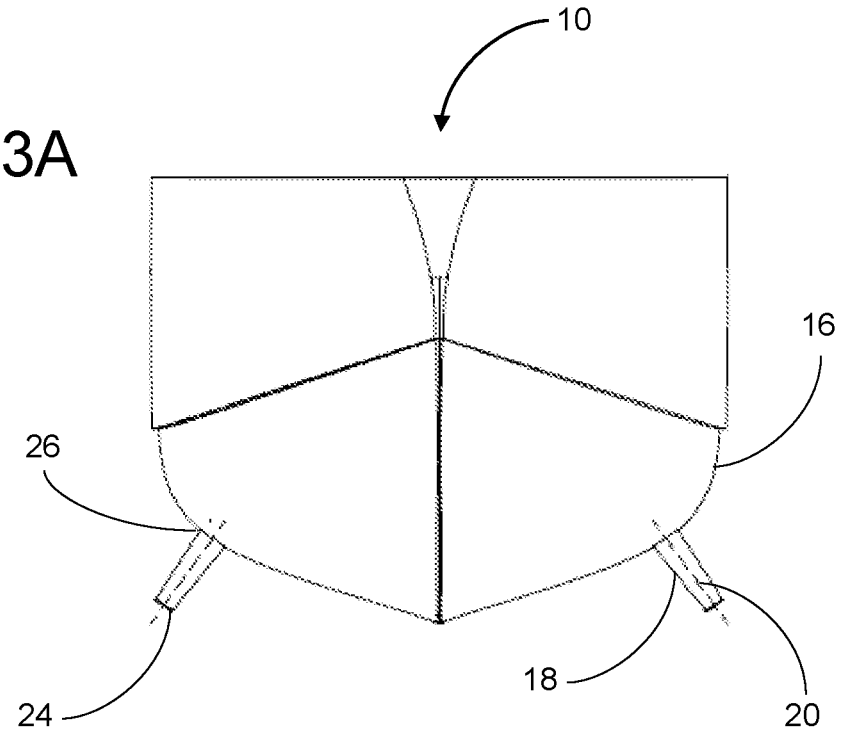
FIG. 3A depicts an orthogonal view facing the bow of the exemplary vessel outfitted with the vessel braking control system of FIGS. 1-2, with the depicted fin in the neutral position.
Figure 3B:
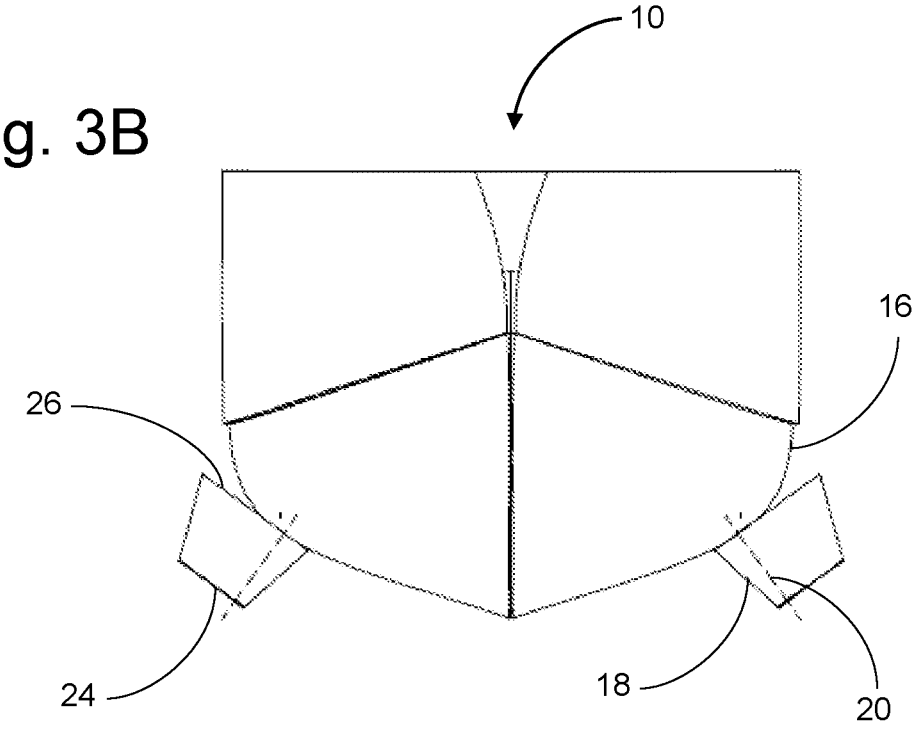
FIG. 3B depicts an orthogonal view facing the bow of the exemplary vessel outfitted with the vessel braking control system of FIGS. 1-2 and 3A, with the depicted fin in a rotated position.

Referring next to FIGS. 3A and 3B, the vessel 10 is shown from the viewpoint facing the bow 12. As with FIGS. 2A and 2B, FIG. 3A shows the vessel 10 with stabilizer fins 18 in the neutral position such that the length of fins 18 is substantially parallel to neutral angle line 20 and the fins' lower, outermost edges 24 are not displaced relative to the upper, innermost edges 26. FIG. 3B shows the orientation of fins 18 when the control system 70 has placed the vessel 10 in the braking protocol, wherein fins 18 are rotated such that their length is angled, up to and including perpendicular to, the neutral angle line 20 and the fins' lower, outermost edges 24 are displaced relative to the upper, innermost edges 26 creating a downward force on the hull 16.

Figure 4A:
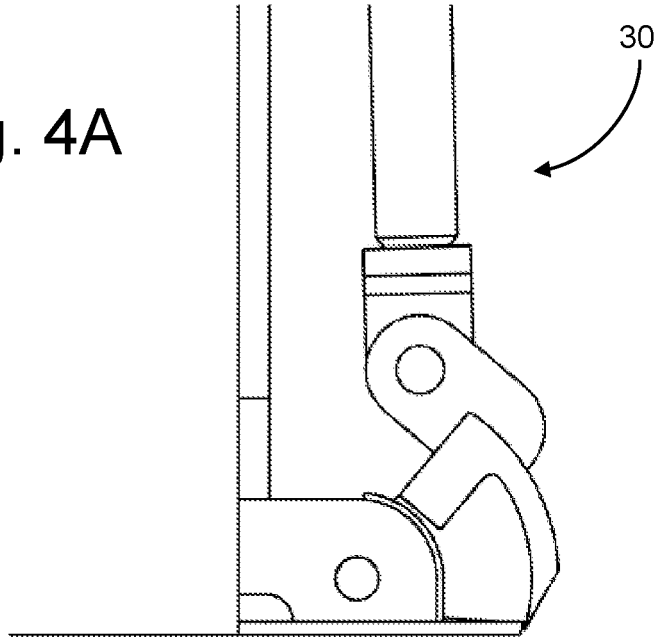
FIG. 4A depicts a partial orthogonal view from the side of a curved blade interceptor utilized by the exemplary vessel outfitted with the vessel braking control system of FIGS. 1-3, the interceptor depicted in an inactive position.
Figure 4B:
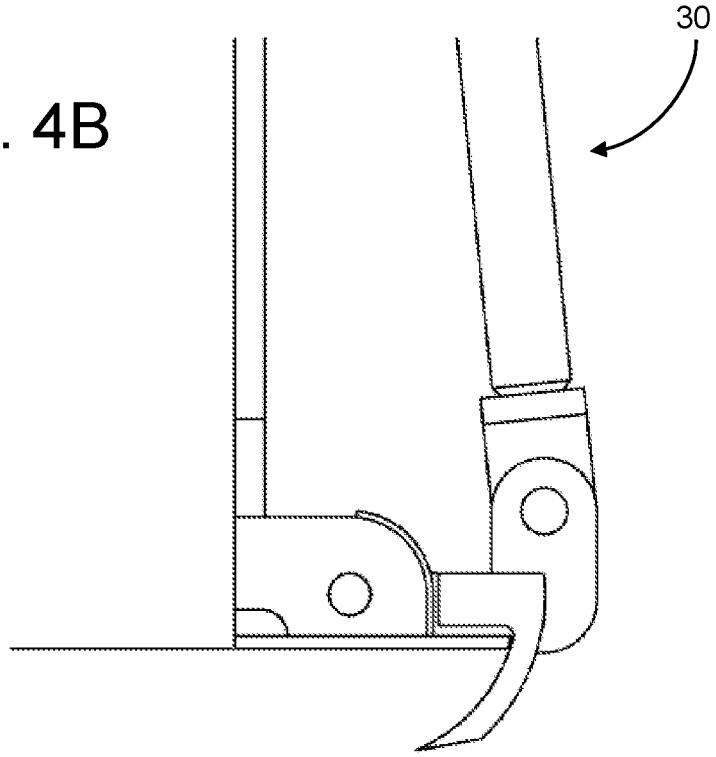
FIG. 4B depicts a partial orthogonal view from the side of an interceptor utilized by the exemplary vessel outfitted with the vessel braking control system of FIGS. 1-3 and 4A, the interceptor depicted in an active position.

Referring now to FIGS. 4A-B, depicted is an exemplary embodiment of a curved blade interceptor 30, one or more of which may be used with preferable embodiments of the present invention's braking control system 70. Interceptors 30, whether curved- or flat-bladed, may be employed in connection with stabilization fins 18, rudders 22, or elsewhere on the vessel's hull 16. As depicted in FIG. 4B, extending the interceptors 30 into the increases drag on the vessel's hull 16 and thereby assists with slowing the vessel 10 in addition to other stabilization benefits.

Referring next to FIGS. 5A-D, depicted is an exemplary embodiment of a T-foil 40, one or more of which may be used with preferable embodiments of the present invention's braking control system 70. T-foils 40 may be employed in connection with stabilization fins 18, rudders 22, or elsewhere on the vessel's hull 16. As depicted in FIGS. 5C-D, T-foils 40 may be rotatable relative to the hull's 16 surface, in some embodiments of the present invention, to further assist in slowing and stabilizing the vessel 10 when deployed by the control system in the braking protocol. Such rotation is preferably bi-directional, as depicted, to improve the versatility of the t-foil's 40 deployment. And T-foils 40 may employ an active trailing flap for lift generation, as depicted in FIG. 5B.

Figure 6A:
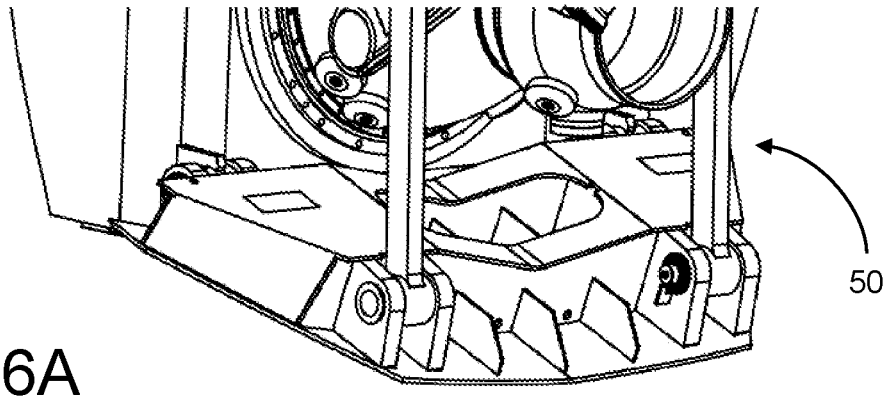
FIG. 6A depicts a partial perspective view of a trim tab utilized by the exemplary vessel outfitted with the vessel braking control system of FIGS. 1-5, the trim tab depicted in an active position.
Figure 6B:
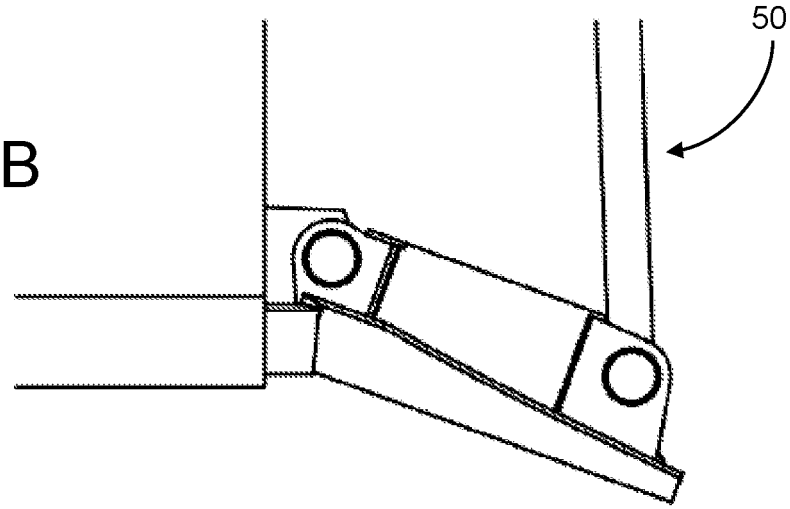
FIG. 6B depicts a partial orthogonal view from the side of a trim tab utilized by the exemplary vessel outfitted with the vessel braking control system of FIGS. 1-5 and 6A, the trim tab depicted in an active position.
Figure 6C:
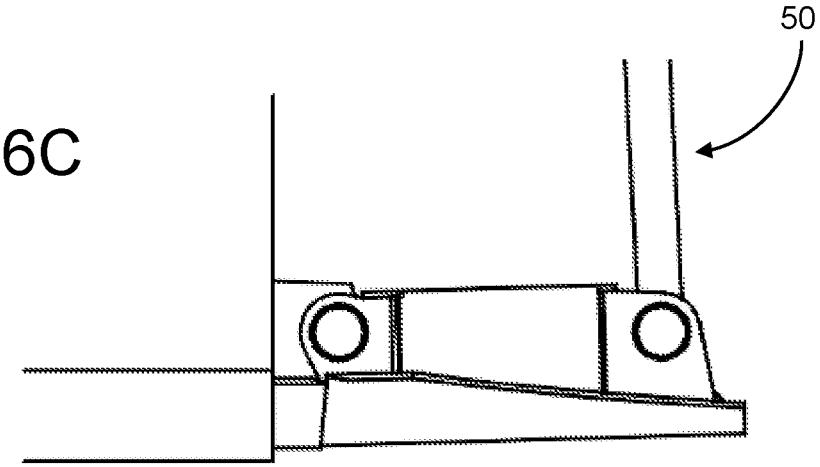
FIG. 6C depicts a partial orthogonal view from the side of a trim tab utilized by the exemplary vessel outfitted with the vessel braking control system of FIGS. 1-5 and 6A-B, the trim tab depicted in an inactive position.

Referring now to FIGS. 6A-C, depicted is an exemplary embodiment of a trim tab 50, one or more of which may be used with preferable embodiments of the present invention's braking control system 70. Trim tabs 50 may be employed in connection with stabilization fins 18, rudders 22, or elsewhere on the vessel's hull 16. As depicted in FIGS. 6A-B, the trim tabs 50 may be extended down into to water and are preferably capable of reaching an angle of 90 degrees or more relative to surface of the vessel's hull 16 in preferable embodiments of the present invention. Like interceptors 30 and T-foils 40, trim tabs 50 are used, when available, by the control system to assist in slowing and stabilizing the vessel 10 when in the braking protocol.

Figure 7:
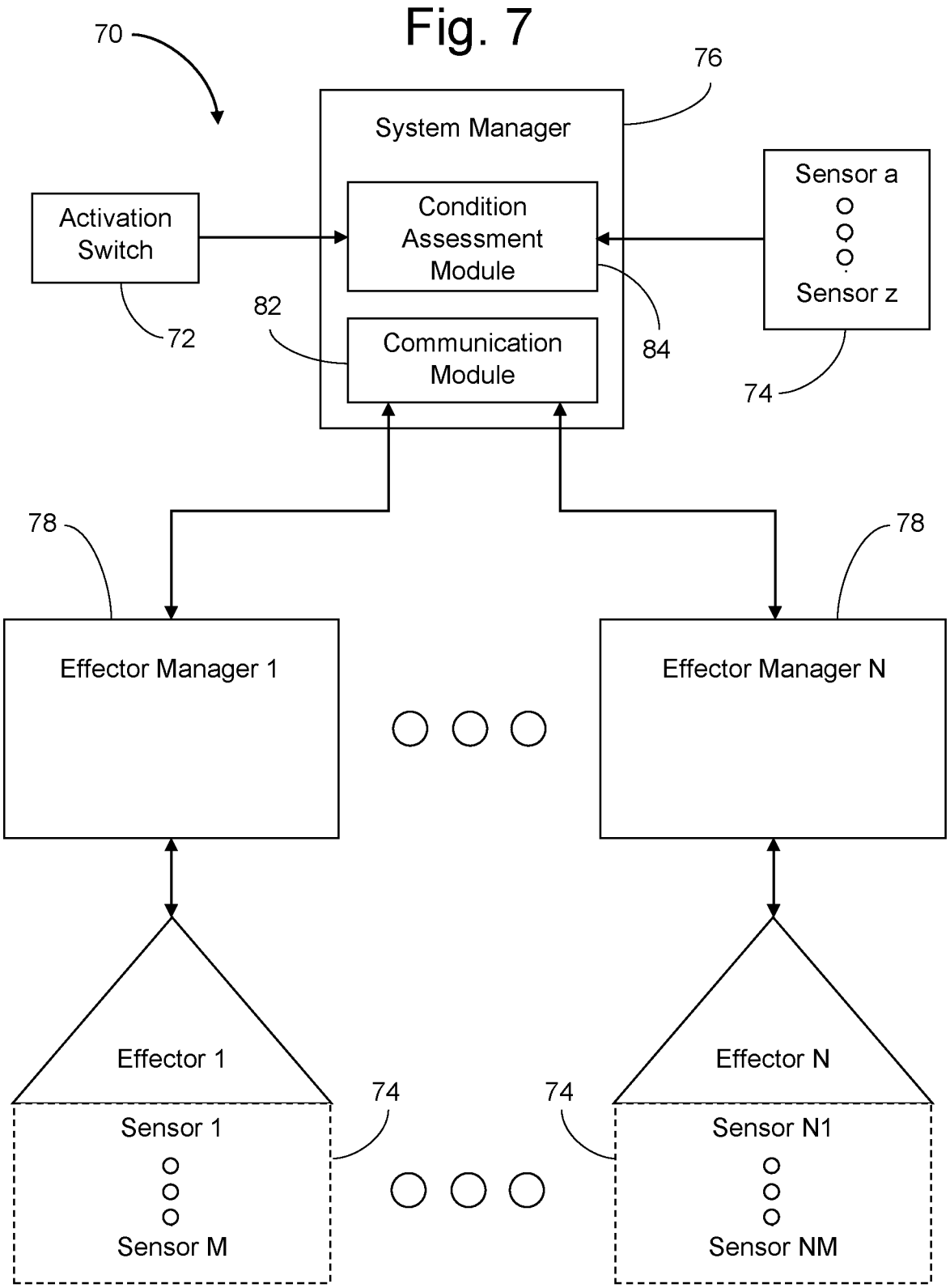
FIG. 7 depicts a schematic representation of a vessel braking control system according to exemplary embodiments of the present invention.

Referring next to FIG. 7, depicted schematically is an exemplary embodiment of the vessel braking control system 70 according to the present invention. The control system 70 employs a system manager 76 that operates to manage placing the vessel 10 into the braking protocol and bringing the vessel 10 out of the braking protocol. The system manager 76 may automatically place the vessel 10 into the braking protocol upon one or more sensors' 74 detection of a predetermined event, such as excess speed, instability, etc., or may place the vessel 10 into the braking protocol based upon the operator's manual engagement of an activation switch 72. Likewise, the system manager 76 may bring the vessel 10 out of the braking protocol upon the sensors' 74 detection of a sufficient speed reduction, a recovery of stability, etc. Preferable embodiments of the control system 70 utilize both manual and automated management of the vessel 10, allowing the operator to engage the braking protocol manually while also monitoring the vessel's 10 status and automatically engaging the braking protocol if the system manager 76 detects an unsafe condition.

The system manager 76 communicates with various effector managers 78 associated with each effector employed by the control system 70 through a communication module 82. Effectors may include, in preferable embodiments, one or more of stabilizer fins 18, rudders 22, interceptors 30, T-foils 40, trim tabs 50, and various other known stabilizers, fins, and foils that protrude from the vessel 10 and, specifically, from the vessel's hull 16, such as lifting foils, bow/stern foils, rotating (Magnus effect) cylinders, and other actively controlled effectors. Other above water features, such as parachutes, sails, anchors, etc. may also be deployed as a part of the control system's 70 management of the vessel 10, as will be recognized by those of skill in the art. The system manager 76 assesses information received from the effector managers 78 and sensors 74 using a condition assessment module 84, which operates to determine the present conditions affecting the vessel 10 and determines the best course of action to slow and/or stabilize the vessel 10 and communicates that assessment to the effector managers 78. The system manager 76, effector managers 78, communication module 82, and condition assessment module 84 each preferably employs a computer processor.

Each effector manager 78 associated with each individual effector operates to control the status of its associated effector, placing the effector into the braking protocol upon instruction from the system manager 76. An effector manager 78 may, in some preferable embodiments, obtain data from one or more sensors 74 associated with its associated effector to facilitate its management thereof. Likewise, data accumulated from sensors 74 associated with other effectors may be relayed to each effector manager 78 by the system manager 76 to further facilitate the operation of each effector manager 78 and the control system 70 as a whole. Data obtained and relayed by the sensors 74 may include, in preferable embodiments, the vessel's speed, surge, heave, pitch, roll, yaw, and sway, wind direction and speed, temperature and barometric pressure of the ambient environment, precipitation levels and intensity, speed and direction of water currents, turbulence of the water surface, and conditions affecting particular effectors, such as mechanical failure, damage, etc., among other data that will be recognized by those of skill in the art.

For example, the effector manager 78 associated with each stabilizer fin 18 operates to manage the stabilizer fin's 18 orientation and angle upon activation and deactivation of the braking protocol. One or more sensors 74 associated with the stabilizer fin 18 may inform the effector manager 78 of an unsafe condition detected in the associated stabilizer fin 18, such as excessive angle causing damage or other adverse conditions in the stabilizer fin 18. The effector manager 78 may adjust the rotation angle, pitch angle, orientation, etc. of the stabilizer fin 18 in response to resolve the adverse condition. The effector manager 78 may also then communicate the condition and the adjustment to the system manager 76, which may share that data with the other effector managers 78 to facilitate the most efficient and effective response by the control system 70 as a whole. This description of the operation of an effector manager 78 associated with a stabilizer fin 18 is exemplary only and could apply to any other effector employed by the control system 70, as will be understood to those of skill in the art.

Figure 8:
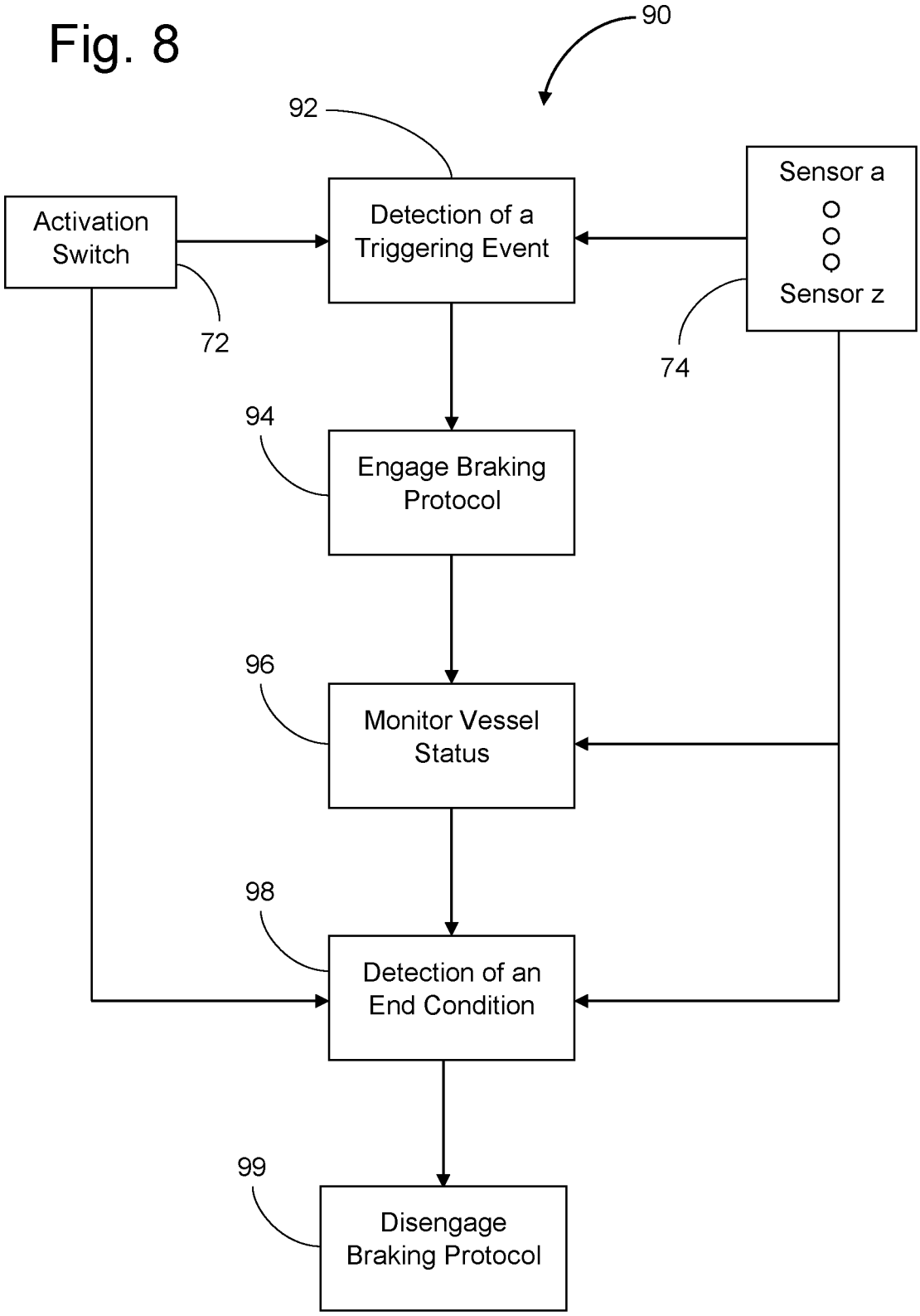
FIG. 8 depicts a schematic representation of the operation of the vessel braking control system according to the exemplary embodiments of the present invention depicted in FIG. 7.

Referring now to FIG. 8, a schematic flowchart of an exemplary embodiment of the control system's operation 90 is depicted. As depicted, the control system 70 awaits a triggering event 92 to activate the braking protocol. Triggering events 92 preferably include the control system's sensors' 74 detection of a predetermined condition or event and an operator's engagement of the activation switch 72. Upon detection of a triggering event 92, the system manager 76 instructs the effector managers 78 to place their associated effectors into their braking protocol positions 94. The system manager 76 monitors data from the sensors 74 and communicates changes in conditions 96 to the effector managers 78 where necessary to facilitate the slowing and/or stabilization of the vessel 10. Upon detecting an end condition 98, the system manager 76 instructs the effector managers 78 to release their associated effectors from the braking protocol 99.

The control system 70 may be associated with a particular vessel 10, in some embodiments, or may operate simultaneously on a fleet of vessels 10. The control system 70 and its components may be provided on the associated vessel 10 or may be provided remotely and connect to the vessel 10 over a network, in some embodiments, or a combination thereof. For example, the system manager 76 may be located remotely while the effector managers 78 are located locally, etc. In preferable embodiments employing sensors 74 and/or an activation switches 72, those features are necessarily provided on the associated vessel 10. Those of skill in the art will recognize the variability of the location of the features of the control system, and their potential use on an individual vessel or across a fleet of numerous vessels.

While the present invention has been described with reference to particular embodiments and arrangements of parts, features, and the like, it is not limited to these embodiments or arrangements. Indeed, modifications and variations will be ascertainable to those of skill in the art, all of which are inferentially and inherently included in these teachings.

What is claimed is:

1. A braking control system for a marine vessel having a hull with a stern, a bow, a port side and a starboard side, the control system comprising:

one or more effectors comprising at least one of stabilization fins, rudders, interceptors, trim tabs, t-foils, lifting foils, bow/stem foils, and rotating Magnus effectors, wherein at least one of the effectors extends from either the bow, the port side or the starboard side of the hull of the marine vessel;

one or more effector managers in electronic communication with the one or more effectors;

a system manager for managing the engagement and disengagement of a braking protocol, the system manager comprising a communication module for communicating electronically with the one or more effector managers;

the one or more effector managers managing the engagement and disengagement of the associated one or more effectors with the braking protocol;

an activation mechanism for engaging and disengaging the braking protocol;

wherein a positioning of each of the one or more effectors is modified from a normal operating position into a braking protocol position when the braking protocol is engaged; and wherein the positioning of each of the one or more effectors is modified from the braking protocol position back into a normal operating position when the braking protocol is disengaged.

2. The braking control system of claim 1, wherein the activation mechanism comprises a manually operated activation switch.

3. The braking control system of claim 2, wherein:

the system manager further comprises a condition assessment module that detects the activation and deactivation of the activation switch; and the system manager engages and disengages the braking protocol upon activation and deactivation of the activation switch.

4. The braking control system of claim 1 further comprising one or more sensors.

5. The braking control system of claim 4, wherein:

the activation mechanism comprises the one or more sensors; and the system manager further comprises a condition assessment module that obtains information from the one or more sensors and assesses the information to determine whether to engage or disengage the braking protocol.

6. The braking control system of claim 5, wherein the information from the one or more sensors comprises at least one of the vessel's speed, surge, heave, pitch, roll, yaw, and sway, wind direction and speed, temperature and barometric pressure of the ambient environment, precipitation levels and intensity, speed and direction of water currents, and turbulence of the water surface.

7. The braking control system of claim 6, wherein the condition assessment module of the system manager determines to engage and disengage the braking protocol based upon predetermined thresholds for one or both of the marine vessel's speed and stability.

8. The braking control system of claim 5, wherein the one or more sensors are affixed to or otherwise associated with the one or more effectors.

9. The braking control system of claim 8, wherein the information from the one or more sensors comprises information about the condition and orientation of the associated effectors.

10. The braking control system of claim 5, wherein:

the activation mechanism further comprises a manually operated activation switch;

the condition assessment module detects the activation and deactivation of the activation switch; and the system manager engages and disengages the braking protocol upon activation and deactivation of the activation switch.

11. The braking control system of claim 10, wherein the condition assessment module of the system manager determines to engage and disengage the braking protocol based upon predetermined thresholds for one or both of the marine vessel's speed and stability.

12. The system of claim 1, wherein:

the one or more effectors comprises at least two stabilization fins extending from the port side and the starboard side, respectively, of the hull of the vessel; and a trailing edge of each of the stabilization fins rotates in the opposite direction of the other when the braking protocol is engaged.

13. A method for slowing and stabilizing a marine vessel having a hull with a stern, a bow, a port side and a starboard side, the method comprising the steps of:

providing a braking control system comprising:

a system manager comprising a condition assessment module and a communication module;

one or more effectors extending from either the bow, the port side or the starboard side of the hull of the marine vessel;

one or more effector managers in electronic communication with the one or more effectors associated with the marine vessel; and an activation mechanism;

detecting, by the condition assessment module of the system manager, a triggering event requiring engagement of a braking protocol;

engaging the braking protocol by modifying the positioning of each of the one or more effectors;

detecting, by the condition assessment module of the system manager, an end condition requiring disengagement of a braking protocol;

disengaging the braking protocol by modifying the positioning of each of the one or more effectors to return to a normal operating position.

14. The method of claim 13, wherein the activation mechanism comprises one or both of a manually operated activation switch and one or more sensors.

15. The method of claim 14, further comprising monitoring conditions affecting the marine vessel using the one or more sensors.

16. The method of claim 15, wherein the monitored conditions affecting the marine vessel include at least one of the vessel's speed, surge, heave, pitch, roll, yaw, and sway, wind direction and speed, temperature and barometric pressure of the ambient environment, precipitation levels and intensity, and turbulence of the water surface.

17. The method of claim 16, wherein the triggering event comprises at least one of the manual operation of the activation switch and the marine vessel surpassing predetermined thresholds for one or both of the marine vessel's speed and stability.

18. The method of claim 17, wherein:

at least one of the one or more sensors is affixed to or otherwise associated with the one or more effectors; and the monitored conditions affecting the marine vessel further include the condition of the one or more effectors.

19. The method of claim 13, wherein the one or more effectors are provided on the hull of the marine vessel and comprise at least one of stabilization fins, rudders, interceptors, trim tabs, t-foils, lifting foils, bow/stem foils, and rotating Magnus effectors.

* * * * *